US008904777B2

(12) United States Patent
Koga

(10) Patent No.: US 8,904,777 B2
(45) Date of Patent: Dec. 9, 2014

(54) HYDRAULIC PUMP CONTROL DEVICE FOR CONSTRUCTION MACHINE

(75) Inventor: Nobuhiro Koga, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 480 days.

(21) Appl. No.: 13/400,843

(22) Filed: Feb. 21, 2012

(65) Prior Publication Data

US 2012/0247094 A1 Oct. 4, 2012

(30) Foreign Application Priority Data

Mar. 31, 2011 (JP) ..... 2011-079398

(51) Int. Cl.
*F16D 31/02* (2006.01)
*E02F 9/22* (2006.01)
*F04B 49/08* (2006.01)

(52) U.S. Cl.
CPC ..... *E02F 9/2235* (2013.01); *E02F 9/2296* (2013.01); *E02F 9/2285* (2013.01); *E02F 9/2292* (2013.01); *F04B 49/08* (2013.01); *E02F 9/2282* (2013.01)
USPC ..... 60/434; 60/452

(58) Field of Classification Search
USPC ..... 60/431, 433, 434, 445, 452
See application file for complete search history.

(56) References Cited

U.S. PATENT DOCUMENTS 5,638,677 A * 6/1997 Hosono et al. ..... 60/434
7,512,471 B2 3/2009 Nakamura et al.
2006/0167607 A1 7/2006 Nakamura et al.

FOREIGN PATENT DOCUMENTS

JP 62-134902 8/1987
JP 04-194383 7/1992
JP 11-125187 5/1999
JP 2002-317471 10/2002
JP 2005-61322 3/2005
JP 2005-76683 3/2005
JP 2005-147040 A 6/2005

OTHER PUBLICATIONS

Office Action issued Sep. 2, 2014 in Japanese Patent Application No. 2011-079398.

* cited by examiner

*Primary Examiner* — Michael Leslie

(74) *Attorney, Agent, or Firm* — Oblon, Spivak, McClelland, Maier & Neustadt, L.L.P.

(57) ABSTRACT

A pump control device for a construction machine includes a pump regulator, a pump pressure detector, a travelling operation detector, a working operation detector, and a controller instructing the pump flow rate depending on the pump pressure to the pump regulator. The controller stores first and second P-Q characteristics as a horsepower characteristic and instructs the pump flow rate to the pump regulator, based on the first P-Q characteristic when a travelling operation is detected, and based on the second P-Q characteristic when a working operation is detected. The second P-Q characteristic is equal to the first P-Q characteristic in a low-pressure region while is one giving a low characteristic relatively to the first P-Q characteristic so as to increase a horsepower difference as the pump pressure increases, in intermediate-pressure and high-pressure regions.

6 Claims, 7 Drawing Sheets

HYDRAULIC PUMP CONTROL DEVICE FOR CONSTRUCTION MACHINE

BACKGROUND OF THE INVENTION

1. Field of the Invention

The present invention relates to a device for controlling a hydraulic pump provided in a construction machine such as a hydraulic excavator.

2. Description of the Background Art

The background art of the invention will be explained by describing a hydraulic excavator. A general hydraulic excavator includes a crawler-type lower propelling body, and an upper slewing body loaded on the lower propelling body slewably about an axis normal to the ground, the upper slewing body attached with a working attachment. The attachment includes a boom, an arm, a bucket, a boom cylinder for raising and lowering the boom, an arm cylinder for pivotally moving the arm, and a bucket cylinder for pivotally moving the bucket. The hydraulic excavator further includes, as hydraulic actuators other than the above cylinders, left and right travelling motors for travelling the lower propelling body and a slewing motor for slewing the upper slewing body.

In such a hydraulic excavator, there is performed a horsepower control of controlling a discharge amount (pump discharge amount) of a hydraulic pump in accordance with a pump pressure i.e. a load pressure of the hydraulic pump. Generally, as a characteristic for the horsepower control for constant horsepower control of keeping the horsepower constant, set is a P-Q diagram as shown in FIG. 7, based on which a pump flow rate in accordance with the pump pressure is determined.

However, for the hydraulic excavator, it is not absolutely preferable to perform the control of always keeping the horsepower constant. Specifically, the travelling operation in a high pressure region requires a greater horsepower than the operation for work e.g. excavation by the actuators other than the travelling motors, while a working operation is performed in a low-pressure region or in an intermediate-pressure region (e.g. from 10 MPa to 20 MPa), seldom in a high-pressure region. Hence, setting the P-Q diagram representing constant horsepower control as a horsepower characteristic on the basis of the horsepower during a travelling operation time may cause energy loss during the working operation time, which resultantly lowers the fuel consumption rate; on the contrary, determining the horsepower on the basis of the horsepower during a working operation time may cause a horsepower shortage during a travelling operation time, particularly when the machine travelling on an uphill or travelling on a slope.

Japanese Utility Model Unexamined Publication No. SHO 62-134902 discloses a technology for solving the above problem. As shown in FIG. 8, the technology includes: setting in advance two types of characteristics which differ from each other in the horsepower substantially throughout the entire pump pressure range, namely, a characteristic A that gives a horsepower relatively large as a whole and a characteristic B that gives a horsepower relatively small as a whole; and selecting the characteristic A during a travelling operation time and the characteristic B during a working operation time, respectively. The technology lowers the horsepower as a whole during the working operation time to suppress energy loss, thereby improving the fuel consumption rate. However, this involves a harmful effect of a lowed flow rate in the low-pressure region and in the intermediate-pressure region, which are practical regions, the lowered flow rate delaying the cycle time for a working operation to thus lower the working efficiency.

SUMMARY OF THE INVENTION

An object of the invention is to provide a pump control device for a construction machine, the device being capable of establishing both of a high working efficiency and a good travelling performance during a working operation time, and improving the fuel consumption rate during a working operation time. The pump control device is installed in a construction machine having a travelling motor, a working actuator other than the travelling motor, and a variable displacement hydraulic pump as a hydraulic source for the travelling motor and for the working actuator, to control the hydraulic pump. The pump control device comprises: a pump regulator which changes a pump flow rate at which hydraulic fluid is discharged from the hydraulic pump; a pump pressure detector which detects a pump pressure at which the hydraulic fluid is discharged from the hydraulic pump; a travelling operation detector which detects a travelling operation performed to drive the travelling motor; a working operation detector which detects a working operation to drive the working actuator; and a controller which instructs the pump flow rate depending on the pump pressure to the pump regulator. The controller stores a first P-Q characteristic and a second P-Q characteristic as a horsepower characteristic, which is a characteristic of the pump flow rate with respect to the pump pressure, and determines the pump flow rate based on the first P-Q characteristic to instruct the determined pump flow rate to the pump regulator in the case where the travelling operation detector detects the travelling operation, while determines the pump flow rate based on the second P-Q characteristic to instruct the determined pump flow rate to the pump regulator in the case where the working operation detector detects the working operation; wherein, the second P-Q characteristic is equal to the first P-Q characteristic in a low-pressure region while the second P-Q characteristic is one giving a lower horsepower relatively to the first P-Q characteristic so as to increase a horsepower difference between the first P-Q characteristic and the second P-Q characteristic as the pump pressure increases, in an intermediate-pressure region and in a high-pressure region.

These and other objects, features and advantages of the present invention will become more apparent upon reading the following detailed description along with the accompanying drawings.

DESCRIPTION OF THE PREFERRED EMBODIMENTS

Figure 1:
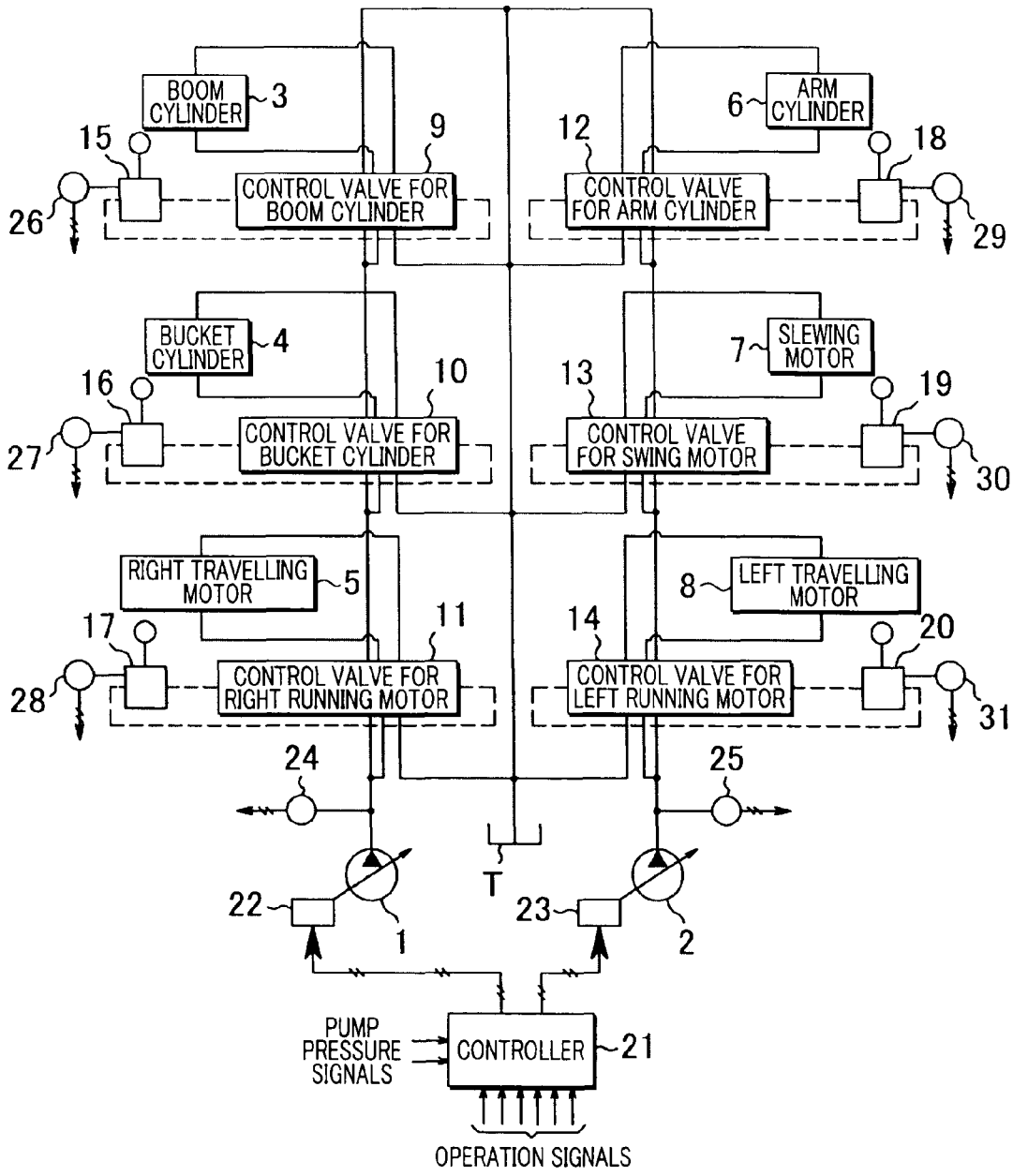
FIG. 1 is diagram showing a hydraulic circuit and a controller for pump control devices as first through third embodiments of the invention.
Figure 2:
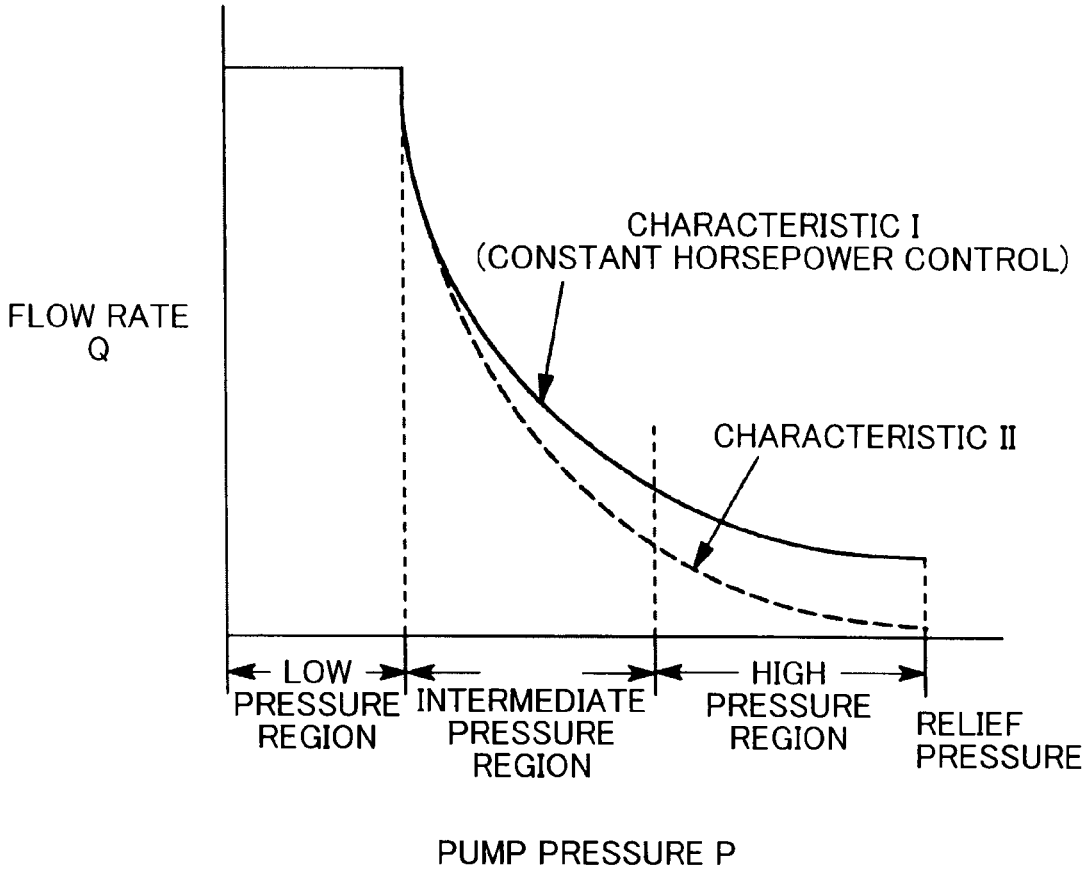
FIG. 2 is a diagram showing a horsepower characteristic in the first embodiment of the invention.
Figure 3:
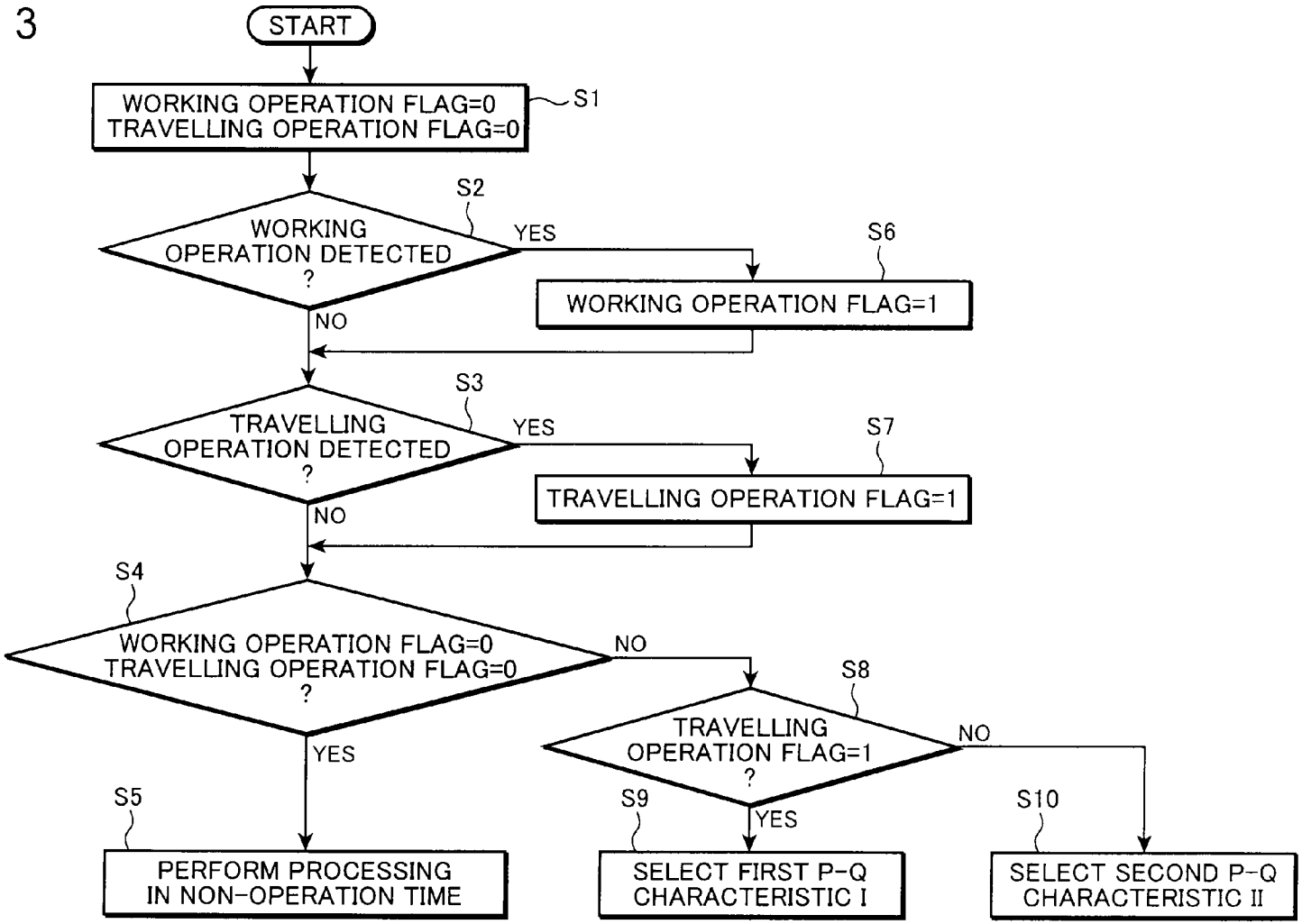
FIG. 3 is a flowchart showing a control operation which the controller performs in the first embodiment.

The first embodiment of the invention is described referring to FIGS. 1 through 3.

FIG. 1 is a circuit diagram showing main elements of a hydraulic excavator provided with a hydraulic pump control device according to the first embodiment. The constituent elements shown in FIG. 1 are also provided in the second and third embodiments to be described later.

The construction machine includes: first and second variable displacement hydraulic pumps 1 and 2; left and right travelling motors 8 and 5 as travelling motors; working actuators other than the travelling motors including a boom cylinder 3, a bucket cylinder 4, an arm cylinder 6, and a slewing motor (hydraulic motor) 7; control valves 9 through 14; a tank T; and a hydraulic control device for controlling the hydraulic pumps 1 and 2.

The first hydraulic pump 1, which is a hydraulic source for the boom cylinder 3, the bucket cylinder 4, and the right travelling motor 5 out of the working actuators, supplies hydraulic fluid to each of the working actuators to drive the working actuators. Likewise, the second hydraulic pump 2, which is a hydraulic source for the arm cylinder 6, the slewing motor 7, and the left travelling motor 8 out of the working actuator, supplies hydraulic fluid to each of the working actuators to drive the working actuators.

The control valves 9 through 14, each of which is a select valve of hydraulic pilot type having a pair of pilot ports, in this embodiment, are interposed between the hydraulic pump 1 and the hydraulic actuators 3 through 5 and between the hydraulic pump 2 and the hydraulic actuators 6 through 8, respectively, and control driving of the hydraulic actuators corresponding to the respective control valves in response to an input of a pilot pressure to either one of the pilot ports.

The control valves 9 through 14 are operated by remote control valves 15 through 20 each of which is an operation device. Specifically, each of the remote control valves 15 through 20 includes an operation lever operable by an operator, and outputs a pilot pressure of a magnitude corresponding to an operation amount of the operation lever, to the pilot port corresponding to an operation direction of the operation lever, out of the paired pilot ports of the control valve corresponding to each one of the remote control valves. The remote control valves 17 and 20 out of the remote control valves 15 through 20 are operated to actuate the control valves 11 and 14 corresponding to the right travelling motor 5 and to the left travelling motor 8, respectively, the operation of each of the remote control valves 17 and 20 corresponding to a "travelling operation". Besides, the remaining remote control valves 15, 16, 18 and 19 are operated to actuate the control valves 9, 10, 12 and 13 corresponding to the boom cylinder 3, the bucket cylinder 4, the arm cylinder 6 and the slewing motor 7 as working actuators, respectively, the operation of each of the remote control valves 15, 16, 18 and 19 corresponding to a "working operation".

The pump control device includes a controller 21, pump regulators 22 and 23, pump pressure sensors 24 and 25, and pilot pressure sensors 26, 27, 28, 29, 30 and 31 provided for the remote control valves 15, 16, 17, 18, 19 and 20 respectively.

The pump regulators 22, 23, which are provided for the first and second hydraulic pumps 1 and 2 respectively, are actuated by an instruction from the controller 21. Specifically, the pump regulators 22 and 23 change the respective tilt angles to thus change the respective pump flow rates of the hydraulic pumps 1 and 2 corresponding thereto respectively. The pump pressure sensors 24 and 25 correspond to pump pressure detectors which detect respective pump pressures i.e. pressures of hydraulic fluid to be discharged from the hydraulic pumps 1 and 2 corresponding thereto respectively.

The pilot pressure sensors 26 through 31 detect respective pilot pressures outputted from the remote control valves 15 through 20 corresponding thereto respectively. Out of the pilot pressure sensors 26 through 31, each of the pilot pressure sensors 28 and 31 which detect respective pilot pressures of the remote control valves 17 and 20 provided for the travelling motors 5 and 8 respectively corresponds to a travelling operation detector which detects a travelling operation; and each of the pilot pressure sensors 26, 27, 29 and 30 which detect respective pilot pressures of the remote control valves 15, 16, 18 and 19 provided for the cylinders 3, 4, 6 and the slewing motor 7 as working actuators respectively corresponds to a working operation detector which detects a working operation.

The controller 21 corresponds to a controller which instructs a pump flow rate to the pump regulators 22 and 23, based on pump pressure signals i.e. detection signals which are outputted from the pump pressure sensors 24 and 25 respectively, and operation signals i.e. detection signals which are outputted from the pilot pressure sensors 26 through 31 respectively. Specifically, the controller 21 includes: a characteristic storage section which stores a predetermined horsepower characteristic (torque curve), namely, a characteristic of the pump flow rate with respect to the pump pressure; and a flow rate instruction section which determines a required pump flow rate based on the characteristic stored in the characteristic storage, the inputted pump pressure signal, and the inputted operation signal and instructs the determined pump flow rate to the pump regulators 22, 23.

The characteristic storage section of the controller 21 stores a first P-Q characteristic I and a second P-Q characteristic II as represented by the P-Q diagram shown in FIG. 2, as a horsepower characteristic of each of the hydraulic pumps 1 and 2. The first P-Q characteristic I is a characteristic which retains a maximum pump flow rate in a low-pressure region where the pump pressure is low, irrespective of the pump pressure, while applied with a P-Q curve for constant horsepower control on the basis of a horsepower required during a travelling operation time in an intermediate-pressure region and in a high-pressure region. The second P-Q characteristic II is a characteristic which is equal to the first P-Q characteristic I in a low-pressure-side region in the intermediate-pressure region and the low-pressure region, while applied with a P-Q curve which gives a horsepower lower relatively to the first P-Q characteristic I so as to increase a horsepower difference between the first and second P-Q characteristics I and II as the pump pressure P increases, in the remaining regions i.e. in a region other than the low-pressure-side region in the intermediate-pressure region and in the high-pressure region.

The pump flow rate instruction section of the controller 21 determines an operation pattern based on an operation signal which is inputted thereinto and selects a characteristic corresponding to the discriminated operation pattern, out of the two P-Q characteristics I, II, as a characteristic for determining the pump flow rate corresponding to the pump pressure. Specifically, the pump flow rate instruction section selects the first P-Q characteristic I during a travelling operation time when at least one of the operations of the remote control valves 17 and 20 each of which is a travelling operation device for driving each of the travelling motors 5 and 8 is detected (in other words, when at least one of the pilot pressure sensors 28 and 31 detects a pilot pressure), while selects the second P-Q characteristic II during a working operation time when at least one of the operations of the remote control valves 15, 16, 18 and 19 as a working operation device for driving the working actuators 3, 4, 6 and 7 respectively is detected.

Next is described a concrete computation control operation performed by the controller 21, referring to the flowchart of FIG. 3.

At the start of the control, a working operation flag of 0 and a travelling operation flag of 0 are set, in Step S1, and whether a working operation has been detected is judged in Step S2, and whether a travelling operation has been detected is judged in Step S3. In the case of NO judged in both of Step S2 and S3, the routine proceeds to Step S4 while the working operation flag of 0 and the travelling operation flag of 0 are retained. In the case of YES judged in Step S2, in other words, in the case where a working operation is performed, the routine proceeds to Step S3 after the working operation flag has been set to 1 in Step S6. In the case of YES judged in Step S3, in other words, in the case where a travelling operation is performed, the routine proceeds to Step S4 after the travelling operation flag has been set to 1 in Step S7.

In Step S4, performed is a determination of the working operation flag and the travelling operation flag. In the case of YES judged in Step S4, that is, in the case where both of the working operation flag and the travelling operation flag are 0, which means no detection of either a working operation or a travelling operation, the routine proceeds to Step S5, in which a processing in a non-operation time e.g. a processing of instructing a minimum flow rate to the pump regulators 22, 23 is performed. In the case of NO judged in Step S4, that is, in the case where at least one of the working operation flag and the travelling operation flag is not 0 (in the case where at least one of a travelling operation and a working operation is performed), it is judged whether the travelling operation flag is set to 1, in Step S8. In the case of YES judged in Step S8, that is, in the case where a travelling operation has been detected, the first P-Q characteristic I is selected in Step S9, and a pump flow rate corresponding to the pump pressure is determined based on the selected characteristic, and the determined pump flow rate is instructed to the pump regulators 22 and 23. On the other hand, in the case of NO judged in Step S8, that is, in the case where a working operation has been detected, the second P-Q characteristic II is selected in Step S10, and determination and instruction of a pump flow rate based on the selected characteristic are executed. Besides, in the case where both of a working operation and a travelling operation have been simultaneously detected, that is, in the case of detection of so called a multiple operation, the first P-Q characteristic I is selected because of YES judged in Step S8. This means the priority of the working operation.

The pump flow rate depending on the pump pressure is thus determined based on the first P-Q characteristic I during a travelling operation time while determined based on the second P-Q characteristic II in which the low horsepower and the low pump flow rate are lowered relatively to that of the first P-Q characteristic I as the pump pressure P increases, during a working operation time. This selection of the second P-Q characteristic II during a working operation time as described above makes it possible to improve the fuel consumption rate to suppress energy loss during a working operation time. Furthermore, during a working operation time, particularly, during an excavation by a hydraulic excavator, the actuation speed of the actuator is inherently so low in the high-pressure region that the suppression of the horsepower during a working operation time hardly affects the working operation time. Hence, the above control actually cannot lower the working efficiency. Besides, lowering the horsepower in the high-pressure region reduces heat generation, resulting in the improved heat balance during a working operation time. On the other hand, a high horsepower (a large flow rate) is obtained in the intermediate-pressure region and in the high-pressure region during a travelling operation time, which makes it possible to secure a horsepower required in a travelling operation time including a time when the machine runs on an uphill or runs on a slope to obtain satisfactory travelling performance. Thus, both of high working efficiency and high travelling performance during a working operation time can be established, and the fuel consumption rate during a working operation time is improved.

Figure 4:
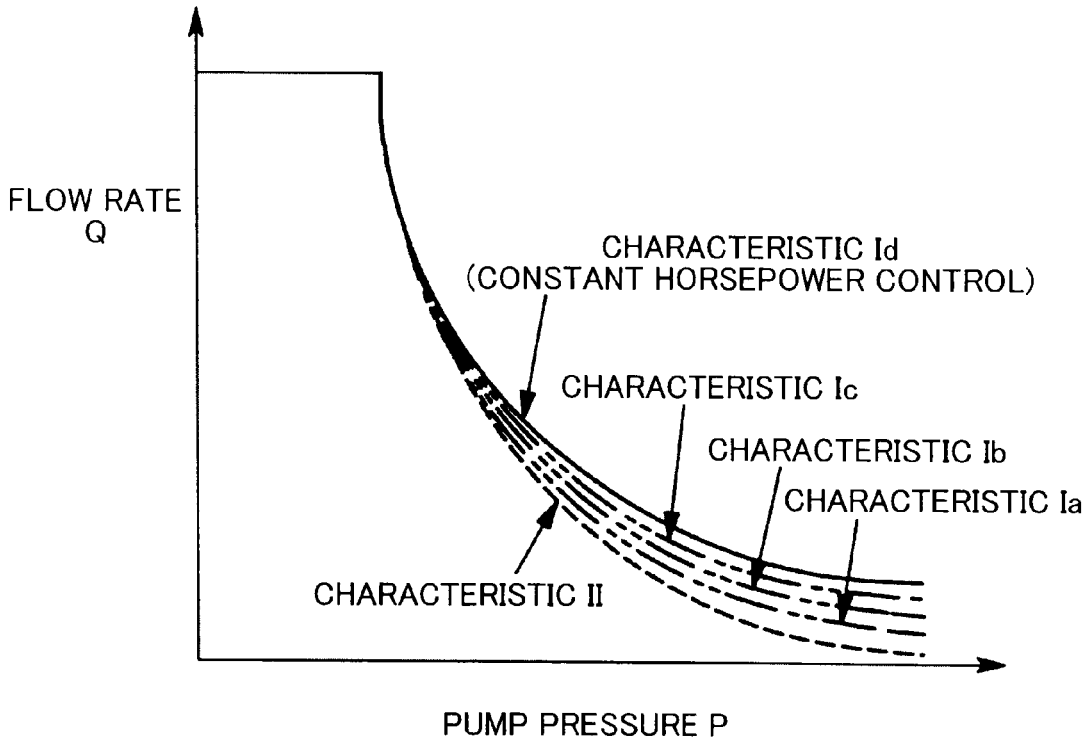
FIG. 4 is a diagram showing a horsepower characteristic in the second embodiment of the invention.
Figure 5:
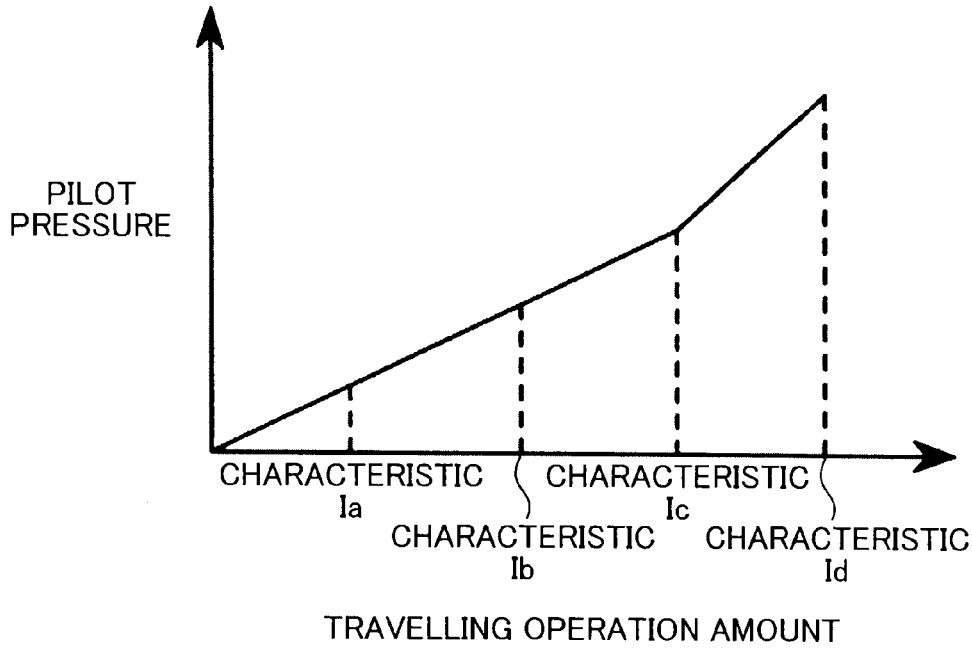
FIG. 5 is a diagram showing a relationship between an operation amount of a remote control valve and a pilot pressure in the second embodiment.
Figure 6:
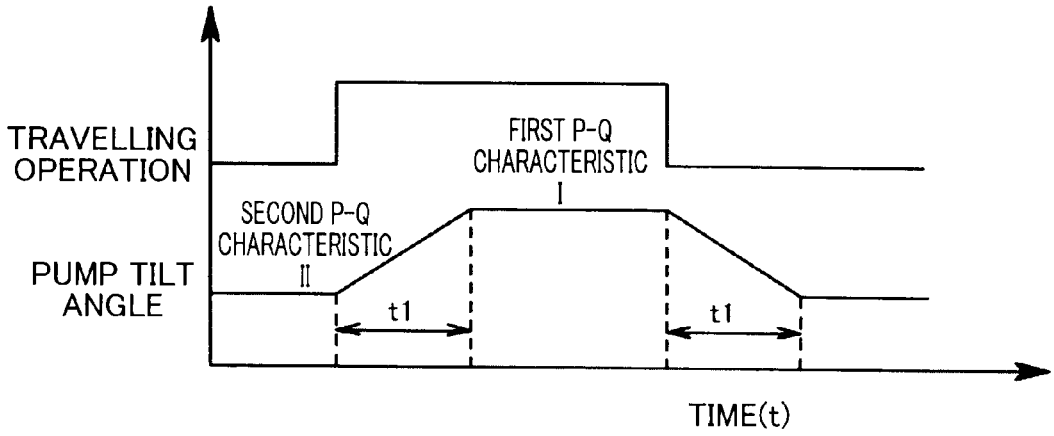
FIG. 6 is a diagram showing a change in a travelling operation and in a pump tilt angle with time in the third embodiment of the invention.
Figure 7:
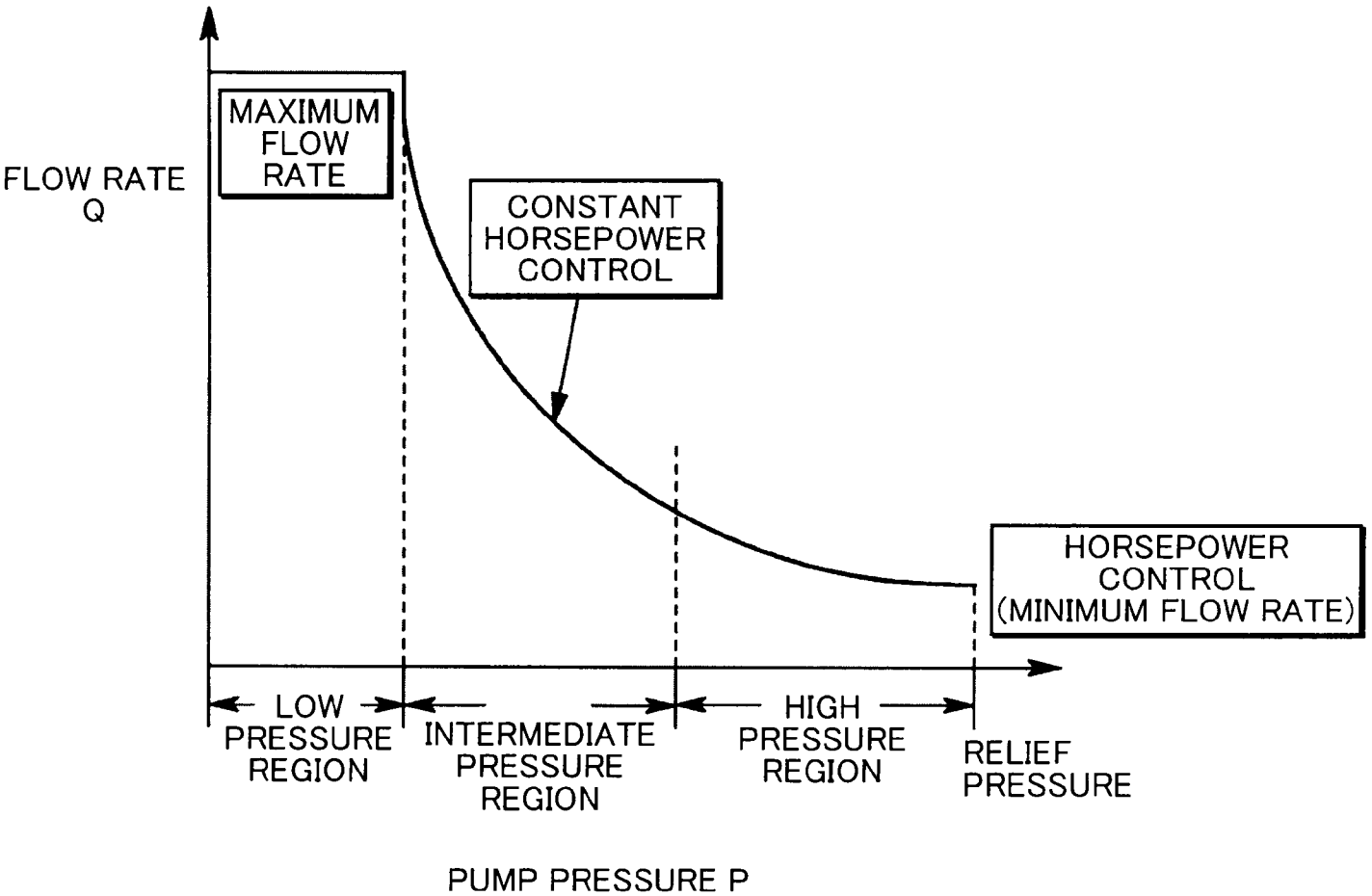
PRIOR ART FIG. 7
FIG. 7 is a diagram showing a horsepower characteristic in a conventional pump control device.
Figure 8:
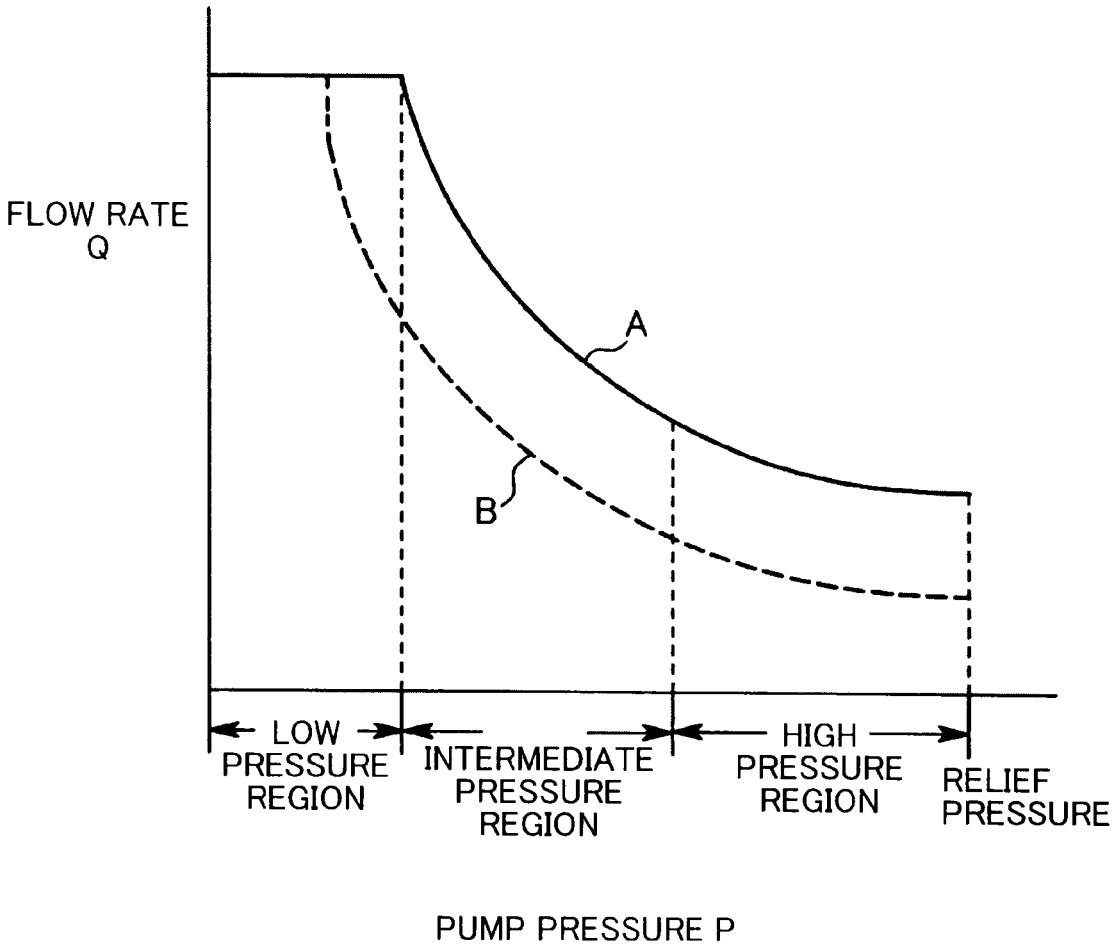
PRIOR ART FIG. 8
FIG. 8 is a diagram showing a horsepower characteristic by the pump control device disclosed in Japanese Unexamined Utility Model Publication No. SHO 62-134902.

Next are described the second and third embodiments with reference to FIGS. 4 through 6.

According to the first embodiment, switching between the first P-Q characteristic I for the travelling operation time and the second P-Q characteristic II for the working operation time is instantaneously performed. This causes a fear of rapid increase in the pump flow rate which may move the attachment fast unexpectedly, for instance, when the travelling operation is performed during a working operation time. In view of this, the second and third embodiments include a control of transient processing of moderately changing the horsepower, upon switching the characteristic between the first P-Q characteristic I and the second P-Q characteristic II.

Specifically, the controller 21 according to the second embodiment shown in FIGS. 4 and 5 includes a characteristic storage section which stores, as the first P-Q characteristic I, a plurality of P-Q characteristics, that is, four characteristics Ia, Ib, Ic and Id in the example shown in FIGS. 4, 5, the characteristics giving respective horsepowers different from each other. The controller 21 also includes a pump flow rate instruction section which selects a characteristic corresponding to a travelling operation amount (corresponding to a pilot pressure) from among the four characteristics Ia, Ib, Ic and Id, as the first P-Q characteristic I to thereby determine a pump flow rate so as to increase the horsepower as the operation amount increases. The P-Q characteristic Id out of the four characteristics Ia through Id is equal to the first P-Q characteristic I in the first embodiment, represented by a P-Q curve for constant horsepower control.

FIG. 5 shows a relationship between a travelling operation amount and a characteristic to be selected in correspondence thereto. As shown here, in the second embodiment, the P-Q characteristics Ia through Id are sequentially selected in this order, as the pilot pressure increases (as the travelling operation amount increases), and the P-Q characteristic Id is selected for a full operation. This selection enables the horsepower to be moderately changed.

The third embodiment includes a pump flow rate instruction section which, as shown in FIG. 6, determines a pump flow rate, as a transient processing, so as to moderately change the horsepower with a delay time t1 after the point in time when detection of the travelling operation is started, and after the point in time when the detection is finished (or either one of the points in time may be applied).

Both of the second and third embodiments are intend to prevent a drawback due to switching between the P-Q characteristics, for instance, a drawback that the pump flow rate rapidly increases to move the attachment fast unexpectedly upon the travelling operation during an operation of the working attachment. Particularly, in the second embodiment, changing the horsepower depending on a travelling operation amount enables the horsepower to be set as intended by an operator, thereby allowing the operator to smoothly operate the machine with enhanced operability.

The horsepower characteristic to be stored in the invention is not limited to the characteristic diagrams (P-Q diagrams) as shown in FIG. 2 and FIG. 4. For instance, there may be stored formulas which directly or indirectly specify a relationship between a pump pressure P and a pump flow rate Q as the P-Q characteristics.

For instance, in the case where constant horsepower control is applied to the first P-Q characteristic for a time of detecting the travelling operation, the following relationship as expressed by the formula (1) is established:

$$T=Pq/2\pi \quad (1)$$

wherein q is a displacement capacity of a pump, and T is an outputted torque.

Hence, the pump flow rate Q can be determined by calculating the displacement capacity q of a pump based on the above formula and the pump pressure P.

On the other hand, for the second P-Q characteristic for a time of detecting the working operation, for example, the following relational formula (2) can be given:

$$T=Pq/2\pi-T(P) \quad (2)$$

wherein T(P) is a function of the pump pressure P that increases, as the pump pressure P increases. Accordingly, as the pump pressure P increases, the difference between the torque T (horsepower) corresponding to the formula (1) and the torque (horsepower) corresponding to the formula (2) increases. Besides, in order to make the control throughout the low-pressure-side region in the intermediate-pressure region be substantially equal to the constant horsepower control, the function T(P) may be a quadratic function or a cubic function of the pump pressure P.

By use of e.g. the above formulas (1) and (2), the pump flow rate Q solely can be obtained by calculation. This eliminates the need of complicated computation such as reading a pump flow rate from a map or interpolation, and simplifies the computation to be performed by the controller 21. Besides, the calculation of a pump flow rate based on the formulas as described above can be performed also in the case of combining with other shift horsepower control or the like.

The construction machine to which the inventive hydraulic pump control device is applied is not limited to an excavator. For instance, the invention may be widely applied to the other hybrid construction machine such as a demolishing machine or a crushing machine configured by use of a main body of an excavator.

Furthermore, as an applied technology of the invention, it is possible to prepare two work modes optionally selectable by an operator using a manipulation of a switch or the like and apply the first and second P-Q characteristics I and II in the foregoing embodiments to the respective work modes. Providing the two work modes in a machine requiring a large pump flow rate at a high pressure, such as a forestry machine which performs forestry work, allows an operator to operate the working actuators at a maximum torque substantially in the same manner as in the travelling operation time by selecting the mode corresponding to the first P-Q characteristic I.

As described above, the invention provides a pump control device for a construction machine, the device being capable of establishing both of high working efficiency and high travelling performance during a working operation time and improving a fuel consumption rate during a working operation time. The pump control device is to be installed in a construction machine having a travelling motor, a working actuator other than the travelling motor, and a variable displacement hydraulic pump as a hydraulic source for the travelling motor and for the working actuator, adapted to control the hydraulic pump. The pump control device comprises: a pump regulator which changes a pump flow rate at which hydraulic fluid is discharged from the hydraulic pump; a pump pressure detector which detects a pump pressure at which the hydraulic fluid is discharged from the hydraulic pump; a travelling operation detector which detects a travelling operation performed to drive the travelling motor; a working operation detector which detects a working operation to drive the working actuator; and a controller which instructs the pump flow rate depending on the pump pressure to the pump regulator. The controller stores a first P-Q characteristic and a second P-Q characteristic as a horsepower characteristic, which is a characteristic of the pump flow rate with respect to the pump pressure, and determines the pump flow rate based on the first P-Q characteristic to instruct the determined pump flow rate to the pump regulator in the case where the travelling operation detector detects the travelling operation, while determines the pump flow rate based on the second P-Q characteristic to instruct the determined pump flow rate to the pump regulator in the case where the working operation detector detects the working operation; wherein, the second P-Q characteristic is equal to the first P-Q characteristic in a low-pressure region, while the second P-Q characteristic is one giving a lower horsepower relatively to the first P-Q characteristic so as to increase a horsepower difference between the first P-Q characteristic and the second P-Q characteristic as the pump pressure increases, in an intermediate-pressure region and in a high-pressure region.

The pump control device is capable of improving the fuel consumption rate while suppressing energy loss by determining a pump flow rate based on the second P-Q characteristic which gives a low horsepower relatively to the first P-Q characteristic as the pump pressure increases during a working operation time when a working operation is detected. Moreover, in most of the works including excavation, the actuation speed of the actuator in a high-pressure region is inherently so slow that lowering the output in the high-pressure region hardly affects the working operation time. Hence, there is, actually, no fear of lowered working efficiency. Besides, lowering the horsepower in the high-pressure region reduces heat generation, thereby improving the heat balance during a working operation time. On the other hand, in a travelling operation time when a travelling operation is detected, determining so large a pump flow rate as to increase the horsepower in the intermediate-pressure region and in the high-pressure region, based on the first P-Q characteristic, makes it possible to secure a horsepower required in a travelling operation time including a time when the machine travels on an uphill or on a slope to thereby obtain satisfactory travelling performance.

The first P-Q characteristic may be preferably a P-Q characteristic, for constant horsepower control, determined based on a maximum output of an engine. This characteristic makes it possible to secure a general travelling performance of a construction machine under the constant horsepower control to thus obtain an excellent travelling performance.

The controller may preferably determine the pump flow rate based on the first P-Q characteristic in a multiple operation time when both of the travelling operation and the working operation are detected. The selection of the characteristic prior to the travelling enables sufficient travelling performance to be secured even in the multiple operation time.

The controller may preferably perform a transient processing of moderately changing the horsepower, upon switching the characteristic between the first P-Q characteristic and the second P-Q characteristic. This transient processing makes it possible to prevent a drawback due to switching of the characteristic, such as a drawback that, for example, in the case of performing the travelling operation while the working attachment is operated, rapidly increased pump flow rate causes the attachment to move fast unexpectedly.

Specifically, the controller may preferably store a plurality of P-Q characteristics giving respective horsepowers different from each other as the first P-Q characteristic and, as the transient processing, select the first P-Q characteristic from among the P-Q characteristics so as to change the P-Q characteristic in such a direction that the horsepower increases, as a magnitude of the detected travelling operation increases. The transient processing, being capable of securing a horsepower as intended by an operator performing the travelling operation, enables the operator to smoothly perform the travelling operation.

Alternatively, the controller may determine the pump flow rate, as the transient processing, so as to gradually change the horsepower with a delay time after a point in time when detection of the travelling operation is started, or after a point in time when the detection is finished.

This application is based on Japanese Patent Application No. 2011-079398 filed on Mar. 31, 2011, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A hydraulic pump control device for use in a construction machine provided with a travelling motor, a working actuator other than the travelling motor, and a variable displacement hydraulic pump as a hydraulic source for the travelling motor and for the working actuator, the hydraulic pump control device comprising:

a pump regulator which changes a pump flow rate at which hydraulic fluid is discharged from the hydraulic pump;

a pump pressure detector which detects a pump pressure at which the hydraulic fluid is discharged from the hydraulic pump;

a travelling operation detector which detects a travelling operation performed to drive the travelling motor;

a working operation detector which detects a working operation performed to drive the working actuator; and a controller which instructs the pump flow rate depending on the pump pressure to the pump regulator, wherein the controller stores a first P-Q characteristic and a second P-Q characteristic as a horsepower characteristic which is a horsepower characteristic of the pump flow rate with respect to the pump pressure, and the controller determines the pump flow rate based on the first P-Q characteristic to instruct the determined pump flow rate to the pump regulator in the case where the travelling operation detector detects the travelling operation, while the controller determines the pump flow rate based on the second P-Q characteristic to instruct the determined pump flow rate to the pump regulator in the case where the working operation detector detects the working operation, the second P-Q characteristic being equal to the first P-Q characteristic in a low-pressure region while being a characteristic giving a low horsepower relatively to the first P-Q characteristic so as to increase a horsepower difference between the first P-Q characteristic and the second P-Q characteristic as the pump pressure increases, in an intermediate-pressure region and in a high-pressure region.

2. The hydraulic pump control device according to claim 1, wherein the first P-Q characteristic is a P-Q characteristic for constant horsepower control, determined based on a maximum output of an engine.

3. The hydraulic pump control device according to claim 1, wherein the controller determines the pump flow rate based on the first P-Q characteristic in a multiple operation time when both of the travelling operation and the working operation are detected.

4. The hydraulic pump control device according to claim 1, wherein the controller performs a transient processing of moderately changing the horsepower, upon switching the characteristic between the first P-Q characteristic and the second P-Q characteristic.

5. The hydraulic pump control device according to claim 4, wherein the controller stores a plurality of P-Q characteristics giving respective horsepowers different from each other, as the first P-Q characteristic, and selects, as the transient processing, the first P-Q characteristic from among the plurality of P-Q characteristics so as to change the P-Q characteristic in such a direction that the horsepower increases, as a magnitude of the detected travelling operation increases.

6. The hydraulic pump control device according to claim 4, wherein, as the transient processing, the controller determines the pump flow rate so as to gradually change the horsepower with a delay time after a point in time when detection of the travelling operation is started, or after a point in time when the detection is finished.

* * * * *